US005921846A

United States Patent [19]

Katz

[11] Patent Number: 5,921,846

[45] Date of Patent: Jul. 13, 1999

[54] LUBRICATED HIGH SPEED FLUID CUTTING JET

[75] Inventor: Joseph Katz, Baltimore, Md.

[73] Assignee: The Johns Hopkins University, Baltimore, Md.

[21] Appl. No.: 08/822,775

[22] Filed: Mar. 21, 1997

[51] Int. Cl.[6] ..... B24B 1/00; B24C 5/04

[52] U.S. Cl. ..... 451/28; 451/38; 451/53; 451/56; 451/102; 451/449

[58] Field of Search ..... 239/596, 600, 239/302, 335, 336; 451/38, 39, 40, 53, 56, 102, 449; 83/53, 177

[56] References Cited

U.S. PATENT DOCUMENTS

| | | | |
|---|---|---|---|
| 3,972,150 | 8/1976 | Hart . | |
| 4,134,547 | 1/1979 | Gamst . | |
| 4,478,368 | 10/1984 | Yie . | |
| 4,555,872 | 12/1985 | Yie . | |
| 4,587,772 | 5/1986 | Griffiths . | |
| 4,648,215 | 3/1987 | Hashish et al. . | |
| 4,723,387 | 2/1988 | Krasnoff . | |
| 4,771,580 | 9/1988 | Male | 451/102 |
| 4,872,293 | 10/1989 | Yasukawa et al. . | |
| 4,984,396 | 1/1991 | Urakami | 451/102 X |
| 4,995,202 | 2/1991 | Gardner et al. | 451/102 |
| 5,018,317 | 5/1991 | Kiyoshige et al. . | |
| 5,060,471 | 10/1991 | Torkelson . | |
| 5,099,619 | 3/1992 | Rose | 451/102 X |
| 5,184,434 | 2/1993 | Hollinger et al. . | |
| 5,335,459 | 8/1994 | Dale . | |
| 5,407,503 | 4/1995 | Matsui et al. . | |
| 5,599,223 | 2/1997 | Mains . | |
| 5,662,266 | 9/1997 | Zurecki et al. . | |
| 5,667,430 | 9/1997 | McPhee et al. | 451/102 X |
| 5,704,825 | 1/1998 | LeCompte | 451/102 |
| 5,721,402 | 2/1998 | Parente . | |

OTHER PUBLICATIONS

"Abrasive Water–Jet Cutting of Metal Without Heat," *Tooling& Production*, pp. 64–65, May 1985.

Gary Ayers, "Principles of Waterjet Cutting," *Tappi Journal*, Sep. 1987, pp. 91–94.

*Primary Examiner*—Timothy V. Eley
*Attorney, Agent, or Firm*—Larry J. Guffey

[57] ABSTRACT

A high speed fluid jet nozzle made at least in part of a porous material and configured so that the porous part of the nozzle is surrounded at least in part by a reservoir containing a lubricant fluid. As a cutting fluid passes through the nozzle, lubricant from the reservoir is drawn through the porous material and lubricates the surfaces of the nozzle exposed to the fluid jet. The invention not only resolves the main difficulties of the prior art relating to nozzle wear, it expands the use and applications of high speed fluid jet cutters. By reducing wear of a jet nozzle, it is possible to increase the jet speed and reduce the nozzle diameter even further than the prior art, allowing much higher precision, deeper cutting, and usage on difficult to cut material such as ceramics. The invention thus provides a reliable but yet very simple method for preventing nozzle wear.

36 Claims, 2 Drawing Sheets

LUBRICATED HIGH SPEED FLUID CUTTING JET

STATEMENT AS TO FEDERALLY SPONSORED RESEARCH

This invention was made with Government support under Grant No. MSS-9320153 awarded by the National Science Foundation. The Government has certain rights in this invention.

BACKGROUND OF THE INVENTION

1. Field of the Invention

This invention relates to high speed fluid cutting jets, and more particularly to high speed slurry jets that use fluid-entrained abrasive particles to cut materials.

2. Description of Related Art

High speed fluid jets ("cutting jets") play an increasingly important role as a tool for cutting a variety of materials. In a cutting jet, a fluid, such as water or gas, entrains abrasive particles to form a slurry which is sprayed from an orifice of a nozzle at very high speeds (typically 100–500 m/sec). Like laser cutting devices, cutting jets are accurate, easily managed, and cause very little loss of material. However, abrasive jet cutting does not involve the high temperatures characteristic of laser cutting, and as a result are suitable for cutting practically any material. Further, the control system required for cutting jets is simpler and much cheaper than for laser cutting systems. Consequently, cutting jets can be used in a broad range of industries, from small machine shops and quarries to the large scale cutting requirements of the automotive and aircraft industries.

The most troublesome difficulty associated with cutting jets is wear of the nozzles, which presently limits their usefulness. Even using very hard materials, the high speed of the fluid, along with a particle size that can be as high as 40% of the nozzle diameter, can rapidly destroy a nozzle. Further, as the nozzle erodes, its kerf, or width of cut, changes, as does the dispersion of the fluid upon exiting from the jet nozzle. Consequently, nozzles must be replaced frequently, resulting in constant maintenance and inspection, loss of accuracy, and machine down time, all of which add to the cost of using a cutting jet.

Present attempts to solve this wear problem include seeding a pure liquid jet with abrasive particles only downstream of the nozzle, use of nozzles made of very hard materials (such as diamonds), using abrasive particles that are softer than the nozzle walls, and attempting to modify the flow structure of the nozzle in order to keep abrasive particles away from the nozzle wall. All of the presently available techniques have major deficiencies. Seeding downstream of the jet reduces the speed of the abrasive particles, and causes considerable expansion, scattering, and unsteadiness of the fluid flow. Diamond nozzles are expensive and almost impossible to form into desirable shapes. Use of abrasive particles softer than the nozzle reduces cutting efficiency. Modification to the jet flow structure by introducing secondary swirling flows near the nozzle walls is useful only with relatively slow flows and small abrasive particles; such modification also causes jet expansion and secondary flow phenomena that limit the capability to control the process.

Accordingly, it would be desirable to have an improved nozzle that overcomes the limitations of the prior art. The present invention provides such an improvement.

SUMMARY OF THE INVENTION

The invention comprises a high speed fluid jet nozzle made at least in part of a porous material and configured so that the porous part of the nozzle is surrounded at least in part by a reservoir containing a lubricant. As a cutting fluid passes through the nozzle, lubricant from the reservoir is drawn through the porous material and creates a thin film of lubricant on the surfaces of the nozzle exposed to the fluid jet.

The invention not only resolves the main difficulties of the prior art relating to nozzle wear, it expands the use and applications of high speed fluid jet cutters. By reducing wear of a jet nozzle, it is possible to increase the jet speed and reduce the nozzle diameter even further than the prior art, allowing much higher precision, deeper cutting, and usage on difficult to cut material such as ceramics. The invention thus provides a reliable but yet very simple method for preventing nozzle wear.

The details of the preferred embodiment of the invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings indicate like elements.

DETAILED DESCRIPTION OF THE INVENTION

Throughout this description, the preferred embodiment and examples shown should be considered as exemplars, rather than as limitations on the invention.

Preferred Structure

Figure 1A:
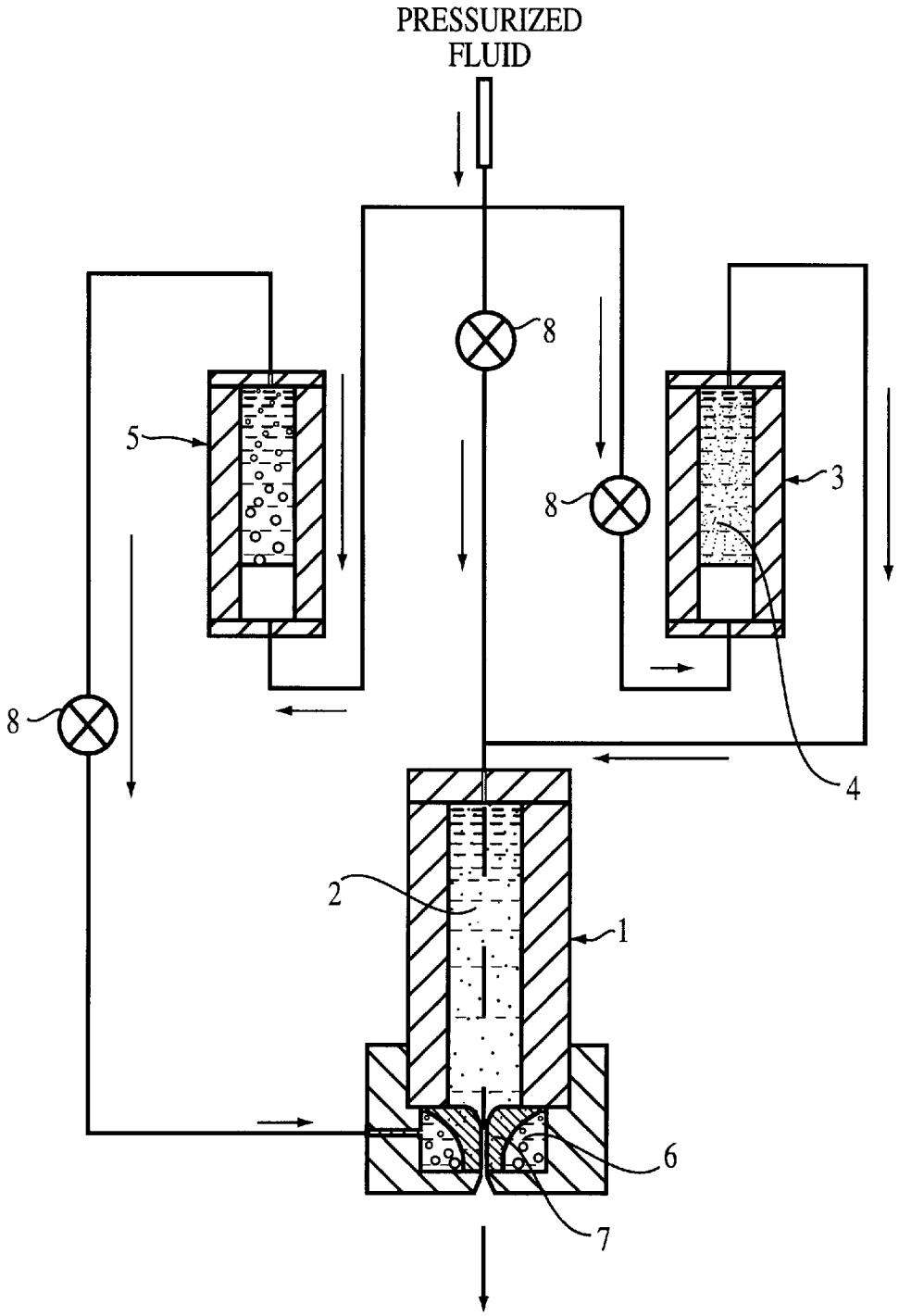
FIG. 1A is a block diagram of the preferred embodiment of the invention, showing a nozzle in cross-section.

FIG. 1A is a block diagram of one embodiment of the invention. A carrier fluid, such as water, is pressurized (e.g., by a high pressure hydraulic pump) and introduced to a cutting head 1 having a slurry mixing chamber 2. The pressurized fluid is also used to pressurize a high density slurry source 3 containing abrasive particles 4 at a concentration of approximately 10–20% by volume; however, other ratios may be used. The abrasive particles may be, for example, fine silica, aluminum oxide, garnet, tungsten carbide, silicon carbide and similar materials.

The outlet of the high density slurry source 3 is coupled to the slurry mixing chamber 2 of the cutting head 1, where the slurry is diluted by the pressurized fluid, typically to about 1–5% by volume. In the preferred embodiment, the pressurized fluid is also used to pressurize a lubricant source 5, the output of which is coupled to a lubricant chamber 6 surrounding a nozzle 7. The nozzle 7 forms one end of the cutting head 1. Manual or automated valves 8 are used to regulate the relative flow rates and pressure of fluid, slurry, and lubricant to the cutting head 1.

Figure 1E:
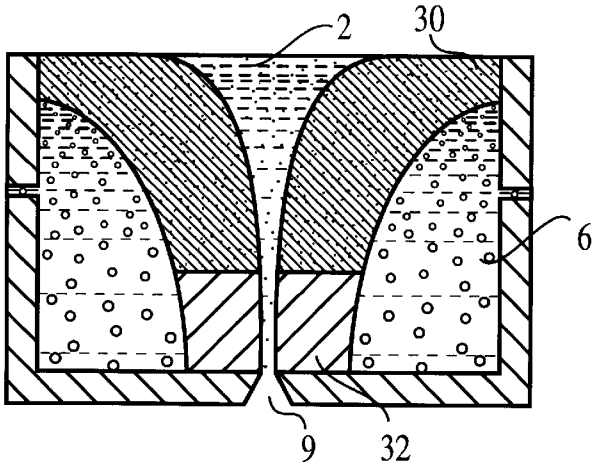
FIG. 1E is a closeup cross-section of an alternative to the nozzle of FIG. 1A.
Figure 1D:
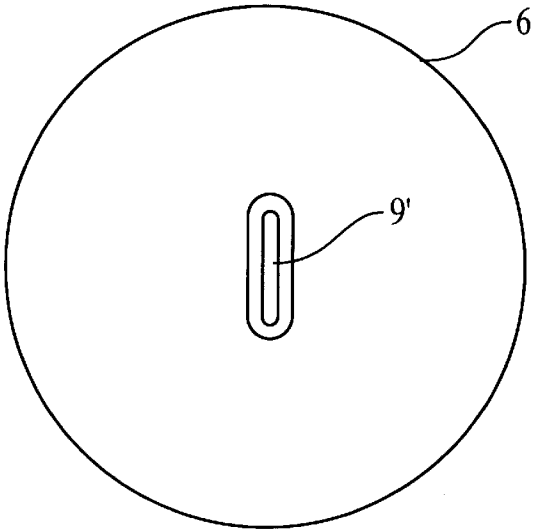
FIG. 1D is an end view of the distal end of an alternative to the nozzle of FIGS. 1A and 1B, showing a linear or slot orifice.
Figure 1B:
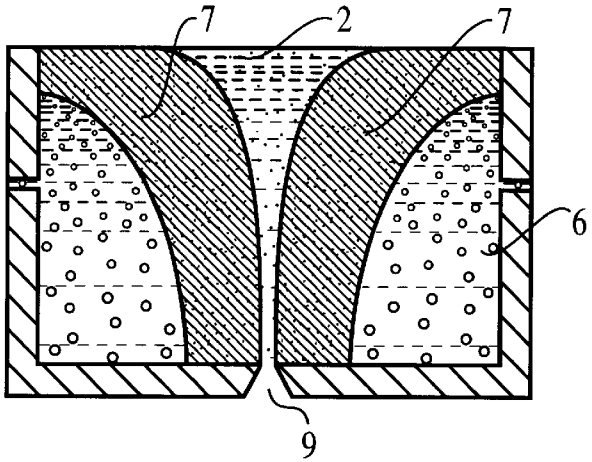
FIG. 1B is a closeup cross-section of the nozzle of FIG. 1A.
Figure 1C:
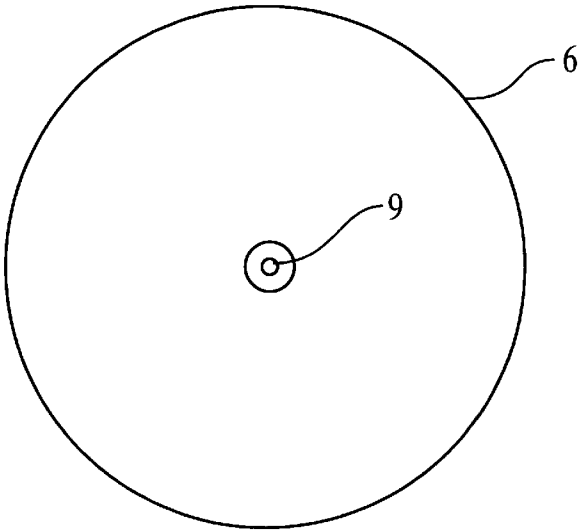
FIG. 1C is an end view of the distal end of the nozzle of FIGS. 1A and 1B, showing a circular orifice.

Referring to FIG. 1B, shown in closeup is the distal end of the cutting head 1. In the preferred embodiment, the nozzle 7 is formed of a porous material. In the embodiment shown in FIG. 1C, the distal end of the nozzle 7 defines an approximately circular jet orifice 9, from which the slurry cutting jet exits the cutting head 1. In a typical embodiment, the smallest cross-sectional dimension (i.e., the diameter, if round) of the jet tip 9 is less than 500 micrometers. Because of the improved performance characteristics resulting from the present invention, the smallest cross-sectional dimension may be as little as twice the diameter of the abrasive particles (presently, fine abrasive particles are typically about 20 $\mu$m).

In the embodiment shown in FIG. 1D, the distal end of the nozzle 7 defines a linear or slotted jet orifice 9', from which the slurry cutting jet exits the cutting head 1. By suitable configuration of a one piece nozzle 7, or by forming the nozzle from two elongated structures having cross-sections similar to that shown in FIG. 1B plus end-caps, a linear orifice of virtually any desired length can be fabricated. Further, multiple orifices can be used, if desired. Other shapes can be used for the orifice 9, such as an ellipse, oval, etc.

Operation

In use, the pressure in the lubricant chamber 6 is higher than the pressure in the slurry mixing chamber 2. The pressure differential may be achieved by a difference in applied pressure, or by a difference in flow rates between the lubricant chamber 6 and the slurry mixing chamber 2. As a result of this pressure difference, lubricant is forced continuously through the porous structure of the nozzle 7 to provide a thin protective layer (film) on the inner wall of the nozzle 7. Since the lubricant is constantly replenished from the lubricant chamber 6, sites where abrasive particles "gouge" the film are "repaired", reducing or preventing damage to the solid walls.

The thickness of the lubricating film is designed to prevent contact (impact) between the particles in the slurry jet and the inner wall of the nozzle 7 and to prevent high stress that would lead to failure of the nozzle wall when the distance between the particle and the wall is very small. An approximated analysis to determine the required thickness of the lubricant layer indicates, for example, that an approximately 5 $\mu$m thick layer of light oil is sufficient to prevent contact between the abrasive particles and the nozzle wall for a 100 $\mu$m diameter, 200 m/sec slurry jet containing 20 $\mu$m diameter abrasive particles with a specific gravity of 2 in a water carrier fluid. For this example, the lubricant viscosity should be about 40 times that of water. In general, the required thickness of the lubricating film is dependent on the flow conditions, including slurry velocity, nozzle geometry, particle specific gravity, shape and void fraction, as well as the lubricant viscosity. In most cases, the lubricant film thickness need be only a few percent (about 1–6%) of the nozzle diameter.

Due to the differences in viscosity between the fluid and the lubricant (typically 40–80:1 if oil is used as the lubricant and water is used as the carrier fluid), and the thinness of the lubricant film, the lubricant flow rate can be kept at a very low level (characteristically, below 0.1% of the carrier fluid flux). Thus, lubricant consumption is minimal.

The lubricant can be of any desired type, so long as the lubricant creates a protective film on the inner wall of the nozzle 7. Use of liquid polymers provides an additional advantage in situations involving high shear strains ($>10^7$) like those occurring in the nozzle 7, since liquid polymers tend to "harden" under such conditions (that is, become less of a viscous material and more of a plastic solid). Thus, liquid polymers can absorb much more energy and stresses from laterally moving abrasive particles. Synthetic, light lubricants (such as poly alfa olefins) that can be easily drawn or forced through a porous medium should provide sufficient protection to the walls of the nozzle 7 under normal conditions. Under preferred conditions, the viscosity of the lubricant should be greater than the viscosity of the abrasive fluid. However, injection of fluid with the same or lower viscosity as the abrasive carrier fluid is also possible as long as the injected fluid creates a protective layer or film along the nozzle walls.

Additional Implementation Details

In the preferred embodiment, the lubricant chamber 5 and slurry chamber 3 are pressurized from the same source. Due to the high speed flow of the slurry through the nozzle 7 and the almost stagnant fluid pool in the lubricant chamber 6, a pressure difference exists between the inner and outer sides of the porous wall of the nozzle 7 that is generally sufficient to draw the lubricant through the porous wall. The lubricant chamber 5 can also be pressurized by a separate pump if need be.

The nozzle 7 can be of any porous material, but is preferably made of a hard, moldable or easily machined porous material, such as a ceramic, metal/ceramic foam, sintered metals, sintered plastic, bonded glass or ceramic beads, porous plastics (e.g., polyethylene, polypropylene, nylon, etc. The pore size can be varied to provide for different lubricant flow rates. Further, the nozzle 7 need not be made completely of porous material. A porous ring 30, such as is shown in FIG. 1E, upstream from a non-porous tip 32, may provide enough lubrication along the inner surface of the tip 32 to substantially reduce erosion. In a different configuration, the porous ring 30 can be downstream of a non-porous portion, where wear would be greatest. Alternatively, a nozzle can be configured with stacked multiple porous and non-porous rings. As another alternative, a nozzle can be configured with stacked multiple porous rings having different lubricant flow rates (for example, due to different porosity or thicknesses).

Moreover, while a uniformly porous material is preferred for the nozzle 7, in an alternative embodiment, a number of very fine to extremely fine holes can be bored (such as by a laser drill) through a nozzle formed of non-porous material to make the nozzle effectively porous. Also, the nozzle can be made of a series of tubes, glued together and formed.

The lubricant injection rate is controlled by the pressure difference across the wall of the nozzle 7, the lubricant viscosity, porous medium permeability, and the thickness of the nozzle wall. The pressure within the nozzle 7 is not constant due to the change in fluid velocity resulting from changes in cross-sectional area of the nozzle 7 and due to shear stresses along the inner wall of the nozzle 7. To insure a desirable lubricant flow rate at every point, the thickness of the porous walls of the nozzle 7 can be varied. The exact shape of the nozzle 7 can be determined by solving the equations of motion for fluid flow in the porous medium with the prescribed flow rate at every point as a boundary condition. Thus, it is possible to prescribe a relatively exact injection rate.

With lubricated walls, the diameter of the nozzle 7 can be substantially decreased to sizes that are only slightly larger than the particle diameter. For example, if the maximum particle diameter is about 20 $\mu$m, the nozzle diameter in principle can be reduced to about 40 $\mu$m, including the oil film. A smaller nozzle diameter provides sharper and more precise cuts with less material loss. As a further consequence of lubricating the nozzle walls exposed to the slurry, the slurry velocity can be increased to considerably higher speeds without damage to the nozzle walls, thereby increasing the abrasive power of the slurry and the cutting efficiency of the system.

The ability to premix the abrasive particles and the carrier fluid within the slurry mixing chamber 2 and nozzle 7 without fear of damage to the nozzle walls has an additional major advantage. Provided that the nozzle 7 is long enough (based on a relatively simple analysis that depends on the nozzle geometry and the abrasive particle specific gravity, which is higher than the carrier fluid), the abrasive particles can be accelerated to the same speed as the fluid. Consequently, the speed and abrasive power of each particle can be maximized.

Although the preferred embodiment of the invention uses liquid as the carrier fluid, the carrier fluid can be a gas or liquid/gas mixture. Further, while the preferred embodiment uses abrasive particles as the principal cutting material, the lubricated nozzle of the invention should also reduce wear due to cavitation when used with only highly pressurized cutting liquid. Thus, "abrasive fluid" or "cutting fluid" should be understood to include fluids with or without entrained abrasive particles.

A number of embodiments of the invention have been described. Nevertheless, it will be understood that various modifications may be made without departing from the spirit and scope of the invention. Accordingly, it is to be understood that the invention is not to be limited by the specific illustrated embodiment, but only by the scope of the appended claims.

What is claimed is:

1. A method for reducing erosion of a porous nozzle due to an abrasive fluid flowing through the porous nozzle, comprising the step of drawing lubricating fluid through pores of the porous nozzle to form a lubricating film between the porous nozzle and the abrasive fluid.

2. A method for reducing erosion of a nozzle due to an abrasive fluid flowing through the nozzle, comprising the steps of:

(a) forming the nozzle of a porous material;

(b) drawing lubricating fluid through the porous material to form a lubricating film between the nozzle and the abrasive fluid.

3. The method of claims 1 or 2, wherein the lubricating fluid has a viscosity at least equal to the viscosity of the abrasive fluid.

4. The method of claim 3, wherein the lubricating fluid is a liquid polymer.

5. The method of claim 3, wherein the lubricating fluid is an oil.

6. The method of claims 1 or 2, wherein the lubricating fluid has a viscosity less than the viscosity of the abrasive fluid.

7. The method of claims 1 or 2, wherein the lubricating fluid has a flow rate substantially less than the flow rate for the abrasive fluid.

8. The method of claim 2, wherein the nozzle has at least one orifice having a smallest cross-sectional dimension less than about 500 microns.

9. The method of claim 8, wherein the nozzle has at least one orifice having a smallest cross-sectional dimension less than about 100 microns.

10. The method of claim 9, wherein the nozzle has at least one orifice having a smallest cross-sectional dimension less than about 40 microns.

11. The method of claims 8, wherein the abrasive fluid has abrasive particles having an average diameter less than about one-half of the smallest cross-sectional dimension of each orifice.

12. A high speed fluid jet cutting nozzle, comprising:

(a) a first chamber for receiving a pressurized cutting fluid, the chamber being defined at least in part by a surface of a wall, at least a portion of the wall being porous, the chamber having an exit tip;

(b) a second chamber, separated from the first chamber by the wall, and in connection with a lubricating fluid;

wherein the lubricating fluid passes through the porous portion of the wall to lubricate the surface of such portion and resist erosion of the wall as pressurized cutting fluid passes from the first chamber to the exit tip.

13. The fluid jet cutting nozzle of claim 12, wherein the exit tip has a smallest cross-sectional dimension less than about 500 microns.

14. The fluid jet cutting nozzle of claim 12, wherein the exit tip has a smallest cross-sectional dimension less than about 100 microns.

15. The fluid jet cutting nozzle of claim 12, wherein the exit tip has a smallest cross-sectional dimension less than about 40 microns.

16. The fluid jet cutting nozzle of claim 12, wherein the cutting fluid has abrasive particles having an average diameter less than about one half of the smallest cross-sectional dimension of the exit tip.

17. The fluid jet cutting nozzle of claim 12, wherein the lubricating fluid has a viscosity at least equal to the viscosity of the cutting fluid.

18. The fluid jet cutting nozzle of claim 17, wherein the lubricating fluid is a liquid polymer.

19. The fluid jet cutting nozzle of claim 17, wherein the lubricating fluid is an oil.

20. The fluid jet cutting nozzle of claim 12, wherein the lubricating fluid has a viscosity less than the viscosity of the cutting fluid.

21. The fluid jet cutting nozzle of claim 12, wherein the lubricating fluid has a flow rate substantially less than the flow rate for the cutting fluid.

22. The fluid jet cutting nozzle of claim 12, wherein the thickness of the porous wall varies to control flow rate of the lubricating fluid.

23. The fluid jet cutting nozzle of claim 12, wherein the porous wall has variable porosity.

24. A fluid jet cutting nozzle system comprising:

(a) a source of pressurized abrasive fluid;

(b) a source of lubricating fluid;

(c) a nozzle, coupled to the source of pressurized abrasive fluid and the source of lubricating fluid, and having a porous wall having an inner surface and an outer surface, the porous wall having at least one orifice, the inner surface defining at least in part a first chamber for receiving the pressurized abrasive fluid, the outer surface defining at least in part a second chamber for receiving the lubricating fluid, wherein the lubricating fluid passes through the porous wall to lubricate at least the inner surface of the porous wall while pressurized cutting fluid exits from the first chamber through the orifices.

25. A fluid jet cutting nozzle system comprising:

(a) a source of pressurized abrasive fluid;

(b) a source of lubricating fluid;

(c) a first chamber, coupled to the source of pressurized abrasive fluid, for receiving the pressurized abrasive fluid, the chamber being defined at least in part by a surface of a wall, at least a portion of the wall being porous, the chamber having at least one orifice;

(d) a second chamber, coupled to the source of lubricating fluid, and separated from the first chamber by the wall, for receiving the lubricating fluid;

wherein the lubricating fluid passes through the porous portion of the wall to lubricate at least a portion of the surface of such wall and resist erosion of the wall while pressurized abrasive fluid exits from the first chamber through the orifices.

26. The fluid jet cutting nozzle of claims 24 or 25, wherein at least one orifice has a smallest cross-sectional dimension less than about 500 microns.

27. The fluid jet cutting nozzle of claim 26, wherein at least one orifice has a smallest cross-sectional dimension less than about 100 microns.

28. The fluid jet cutting nozzle of claim 27, wherein at least one orifice has a smallest cross-sectional dimension less than about 40 microns.

29. The fluid jet cutting nozzle of claim 26, wherein the abrasive fluid has abrasive particles having an average diameter less than about one half of the smallest cross-sectional dimension of each orifice.

30. The fluid jet cutting nozzle of claims 24 or 25, wherein the lubricating fluid has a viscosity at least equal to the viscosity of the abrasive fluid.

31. The fluid jet cutting nozzle of claim 30, wherein the lubricating fluid is a liquid polymer.

32. The fluid jet cutting nozzle of claim 30, wherein the lubricating fluid is an oil.

33. The fluid jet cutting nozzle of claims 24 or 25, wherein the lubricating fluid has a viscosity less than the viscosity of the abrasive fluid.

34. The fluid jet cutting nozzle of claims 24 or 25, wherein the lubricating fluid has a flow rate substantially less than the flow rate for the abrasive fluid.

35. The fluid jet cutting nozzle of claims 24 or 25, wherein the thickness of the porous wall varies to control flow rate of the lubricating fluid.

36. The fluid jet cutting nozzle of claims 24 or 25, wherein the porous wall has variable porosity.

* * * * *